United States Patent [19]

Stumpp et al.

[11] 4,018,200

[45] Apr. 19, 1977

[54] FUEL INJECTION SYSTEM WITH FUEL PRESSURE CONTROL VALVE

[75] Inventors: Gerhard Stumpp, Stuttgart; Wolf Wessel, Schwieberdingen; Volkhard Stein, Stuttgart; Wilfried Sautter, Ditzingen-Schockingen, all of Germany

[73] Assignee: Robert Bosch G.m.b.H., Stuttgart, Germany

[22] Filed: Aug. 13, 1974

[21] Appl. No.: 497,123

[30] Foreign Application Priority Data

Oct. 3, 1973 Germany ..... 2349616

[52] U.S. Cl. ..... 123/139 AW; 123/140 MC

[51] Int. Cl.[2] ..... F02M 39/00; F02D 1/04

[58] Field of Search ... 123/119 R, 139 AW, 139 BL, 123/139 E, 140 MC

[56] References Cited

UNITED STATES PATENTS

| | | | |
|---|---|---|---|
| 3,809,036 | 5/1974 | Knapp et al. | 123/119 R |
| 3,842,813 | 10/1974 | Eckert | 123/149 MC |
| 3,918,228 | 9/1976 | Wessel | 123/139 AW |
| 3,930,481 | 1/1976 | Eckert | 123/139 AW |
| 3,931,802 | 1/1976 | Eckert | 123/139 E |
| 3,974,811 | 8/1976 | Stumpp et al. | 123/32 EA |

*Primary Examiner*—C.J. Husar
*Assistant Examiner*—Paul Devinsky
*Attorney, Agent, or Firm*—Edwin E. Greigg

[57] ABSTRACT

A fuel injection system for a mixture compressing, externally ignited, internal combustion engines employing continuous injection into a suction tube includes a control pressure circuit provided with a throttle. The metering valve is controllably associated with the throttle so that the pressure difference at the metering valve can be changed by changing the pressure difference at the throttle.

12 Claims, 3 Drawing Figures

FUEL INJECTION SYSTEM WITH FUEL PRESSURE CONTROL VALVE

BACKGROUND OF THE INVENTION

This invention relates to a fuel injection system for mixture compressing, externally ignited, internal combustion engines employing continuous injection into a suction tube. The invention relates, more particularly, to such a fuel injection system which contains, in sequence, a measuring member as well as an arbitrarily actuatable butterfly valve, and wherein the measuring member is displaced in accordance with air-flow rate and in opposition to a resetting force. The flowing air displaces the movable part of a valve disposed in a fuel supply line for the purpose of metering out a fuel quantity in proportion to the air quantity, the metering taking place while a constant pressure difference prevails which can, however, be changed in dependence on engine parameters.

It is the purpose of fuel injection systems of this type to create automatically a favorable fuel-air mixture for all operational conditions of the internal combustion engines to make possible a complete combustion of the fuel, and, while maintaining the highest possible performance of the internal combustion engine or the lowest possible fuel consumption, to prevent or at least to reduce sharply the creation of toxic exhaust constituents. This requires that the fuel quantity be very precisely metered out according to the requirements of each operational condition of the internal combustion engine and that the proportionality between the air and fuel quantity be changed in dependence on engine parameters such as r.p.m, load and temperature.

It is already known, in fuel injection systems of this type, to change the pressure difference at a metering valve electromagnetically, using a differential pressure valve. The constantly more stringent legal requirements for exhaust gas constituents make necessary a very precise regulation of the optimum quantity of fuel to be injected.

SUMMARY OF THE INVENTION

It is the principal object of the present invention to provide a fuel injection system of the known type while giving due consideration to the above-mentioned requirements made of such a fuel injection system.

It is another object of the present invention to provide a fuel injection system of the known type which meets the requirement and which is also inexpensive to construct.

The foregoing objects, as well as others which are to become clear from the text below, are achieved in accordance with the present invention by an improved fuel injection system of the known type in which the pressure difference prevailing at the metering valve can be changed by changing the pressure difference at a first throttle within a control pressure circuit.

An advantageous embodiment of the invention provides that the pressure difference at the first throttle can be changed by a magnetic valve disposed within a control pressure loop and that the first throttle is disposed between the supply circuit and the control pressure circuit and wherein there are disposed, in series, downstream from the first throttle, a chamber forming part of an equal pressure valve as well as a second throttle and a magnetic valve, a third throttle being disposed in parallel to the magnetic valve. In this embodiment a pressure regulating valve is located downstream from the magnetic valve in the control pressure circuit.

In another advantageous embodiment of the invention, a second throttle is disposed downstream of the chamber of the equal pressure valve and, parallel to this second throttle, there is disposed a third throttle and the magnetic valve.

Another equally advantageous embodiment of the invention is such that downstream of the chamber of the equal pressure valve, a pressure regulating valve is disposed within the control pressure circuit and parallel to a second throttle, a third throttle being disposed parallel with the magnetic valve. The third throttle and the magnetic valve, in this embodiment, are disposed in series with respect to the stream direction.

In a preferred embodiment of the invention, the second throttle is disposed within the diaphragm of the pressure regulating valve which is itself embodied as a flat seat valve whose movable member is the diaphragm.

In a further preferred embodiment of the invention, a pressure limiting valve is disposed downstream of the pressure regulating valve.

A further advantageous embodiment of the invention is characterized in that, downstream of the first throttle, there is disposed in series a chamber of a differential pressure valve, a second throttle, and the magnetic valve all in series. The differential pressure valve, in this particular embodiment, is embodied as a flat seat valve with a diaphragm separating one chamber from another, the diaphragm being actuated in the opening direction of the valve by a spring disposed in the chamber.

BRIEF DESCRIPTION OF THE DRAWING

Three exemplary embodiments of the invention are illustrated in simplified representation, in the drawing.

DETAILED DESCRIPTION OF THE PREFERRED EMBODIMENT

Figure 1:
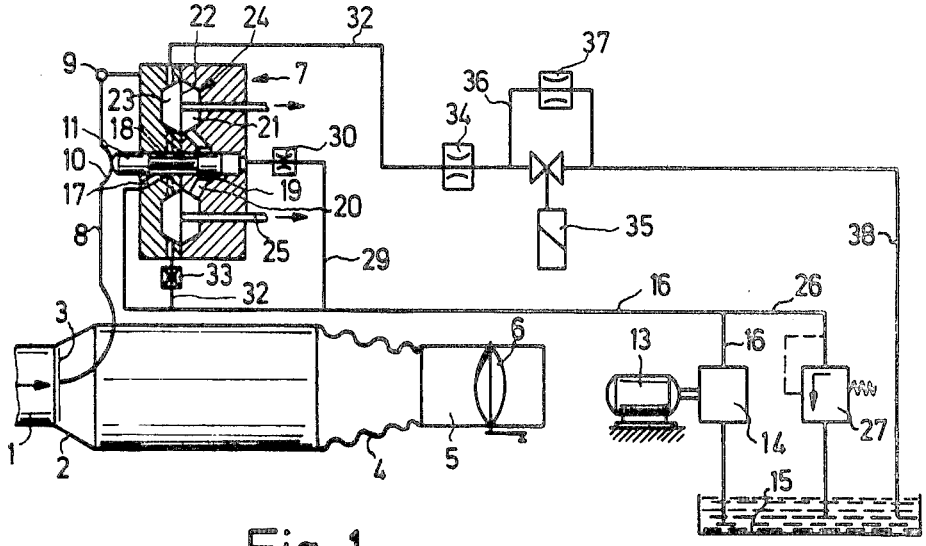
FIG. 1 is a diagrammatic representation of a first exemplary embodiment of a fuel injection system according to the present invention.

In the fuel injection system represented in FIG. 1, combustion air flows in the direction of the arrow into a suction tube 1 having a conical sector 2 containing a measuring member 3. The air flows further through a connecting hose 4 and a suction tube sector 5 containing an arbitrarily actuatable butterfly valve 6 to one or several cylinders (not shown) forming part of an internal combustion engine. The measuring member 3 is a plate disposed transverse to the stream direction which moves within the conical sector 2 of the suction tube 1 according to an approximately linear function of the air quantity flowing through the suction tube 1, whereby the pressure prevailing between the measuring member 3 and the butterfly valve 6 remains constant so long as both the resetting force acting upon measuring member 3 as well as the air pressure prevailing ahead of measuring member 3 remain constant. The measuring member 3 controls directly a metering and quantity divider valve 7. A lever 8, pivotable freely about a pivoting point 9, serves to transmit the setting motions of measuring member 3 and is provided with an extension 10 which actuates the movable valve member of the metering and quantity divider valve 7 embodied as a control slide 11.

An electric motor 13 drives a fuel pump 14 which delivers fuel from a fuel container 15, via a line 16 and a channel 17, into an annular groove 18 of the control slide 11. Depending on the position of the control slide 11, the annular groove 18 more or less overlaps control slits 19, each of which communicates via channels 20 with a respective chamber 21 separated by a respective diaphragm 22 from a respective chamber 23. Each diaphragm 22 serves as a movable member of a flat seat valve embodied as an equal pressure valve 24. Fuel flows from the chambers 21, via channels 25, to individual injection valves which are located in the suction tube 1 in the vicinity of the engine cylinders (not shown).

A line 26, branching off from the line 16, contains a pressure limiting valve 27 which permits the return flow of fuel into the fuel container 15 when the fuel system pressure is too high.

The face of the control slide 11 facing the lever 8 is actuated by pressure fluid which serves as the resetting force for the measuring member 3 and actuates the control slide 11 through a line 29 containing a damping throttle 30.

Also branching off from the line 16 is a line 32 which contains, in series, a first throttle 33, the chambers 23 of the equal pressure valves 24, a second throttle 34, and a solenoid valve 35. A third throttle 37 is disposed in a line 36, parallel to the solenoid valve 35. Unpressurized fuel from the control pressure circuit 32 may return to the fuel container 15 through the third throttle 37 and a return line 38.

The operation of the fuel injection system illustrated in FIG. 1 is set out below.

When the internal combustion engine is running, air is aspirated through the suction tube 1, which includes the sections 4 and 5, and causes a certain displacement of the measuring member 3 from its normal, shown, quiescent position. The excursion of the measuring member 3 is transmitted by the lever 8 to cause a displacement of the control slide 11 in the metering and quantity divider valve 7, which meters out the fuel quantity flowing to the fuel injection valves of the engine. The direct connection between the measuring member 3 and the control slide 11 results in a constant proportion of the air quantity to the metered out fuel quantity.

In order to maintain the fuel-air mixture in a relatively richer or leaner condition, depending on the portion of the operational domain of the internal combustion engine, a change of the proportionality obtaining between aspirated air quantity and metered out fuel quantity is necessary in dependence on motor parameters. The change of the fuel-air mixture can occur, on the one hand, by changing the resetting force acting on the measuring member 3, or on the other hand, by changing the pressure difference prevailing at the metering valve 18, 19. In internal combustion engines which include a plurality of engine cylinders, it is advantageous to embody the valves 24 within the metering and quantity divider valve 7 as equal pressure valves. In advantageous manner, the pressure difference prevailing at the metering valves 18, 19 can be regulated and changed jointly by the pressure prevailing in the control pressure circuit 32. In the present exemplary embodiments, the change of the differential pressure at the metering valves, 18, 19, occurs by changing the differential pressure at the first throttle 33 by making the flow rate through this first throttle 33 changeable. The flow rate change at the first throttle 33 can be readily achieved. To achieve this rate change, a second throttle 34 and a solenoid valve 35, including a parallel third throttle 37, are disposed behind it within the control pressure circuit 32. When the solenoid valve is closed, the fuel quantity flowing through the first throttle 33 is determined by the three throttles 33, 34 and 37. When the solenoid valve 35 is opened, however, the fuel quantity flowing within the control pressure circuit is determined solely by the throttles 33 and 34, resulting in a reduced throttling action and an increased pressure difference across the first throttle 33, which also increases the pressure difference prevailing at the metering valves 18, 19. The change of the differential pressure at the first throttle 33 can be achieved by a variation of the ratio of open duration to closed duration of the solenoid valve 35. In this way, a permanently closed solenoid valve 35 results in a small pressure difference and a lean fuel-air mixture, whereas a permanently opened solenoid valve 35 results in the highest pressure difference and hence the richest fuel-air mixture.

If it is required to dampen the pressure pulses, a storage container or surge tank (not shown) could be disposed within the control pressure circuit 32.

In a further exemplary embodiment of the invention, (not shown) a second throttle could be disposed in the control pressure circuit 32, downstream of the equal pressure valve 24 and parallel thereto a third throttle and the solenoid valve 35. This exemplary embodiment however, might have the disadvantage, with respect to the one depicted in FIG. 1, that the third throttle would have to have a relatively small cross-section and would be thus more susceptible to contamination.

Figure 2:
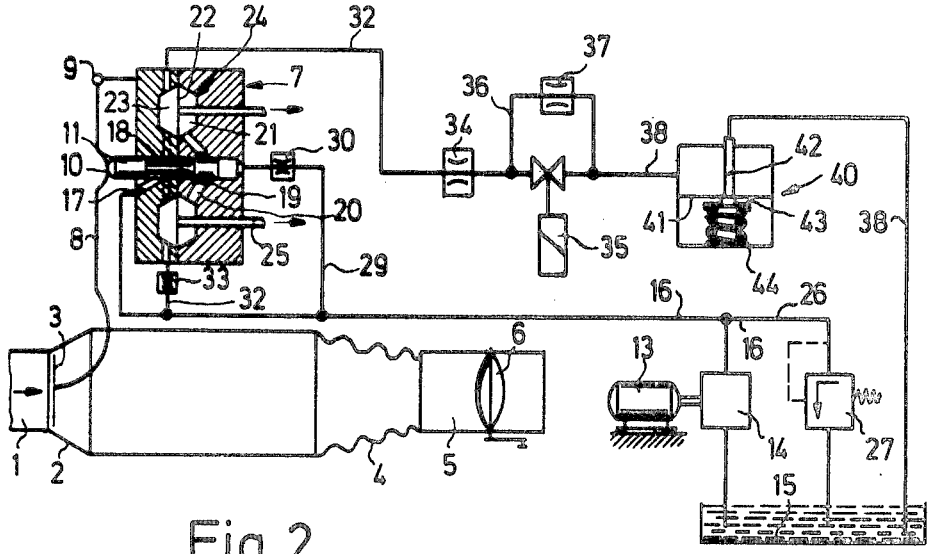
FIG. 2 is a diagrammatic representation of a fuel injection system according to the present invention.

In the second exemplary embodiment as shown in FIG. 2, parts which are identical to those of FIG. 1 retain the same reference numerals. In the first exemplary embodiment, the pressure difference between the system pressure and the atmospheric pressure prevailing in the fuel container 15 takes place within the control pressure circuit 32. When the internal combustion engine is shut off, the system pressure is no longer maintained by the fuel pump 14 and hence decays to atmospheric pressure through the open throttles 33, 34 and 37. However, it is desirable to maintain the system pressure at a certain level even when the internal combustion engine has been shut off. At the same time, when the internal combustion engine is running it is desired that the pressure difference occurs, via the throttle 33, 34 and 37, between the system pressure and this predetermined pressure level. For this purpose, as shown in FIG. 2, the return line 38 contains a pressure regulating valve 40 embodied as a flat seat valve containing a diaphragm 41 as the movable valve member and a fixed valve seat 42. Fuel may return to the fuel container without pressure through this valve 40. The side of the diaphragm 41 facing away from the valve seat 42 is actuated by a spring 44 via a spring support cup 43 in the direction of closing the pressure regulating valve 40.

Figure 3:
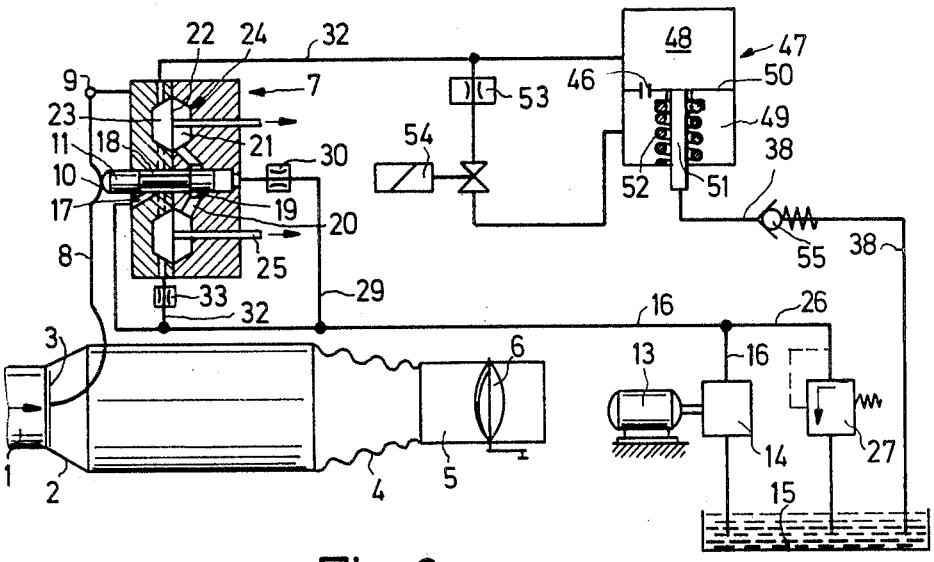
FIG. 3 is a diagrammatic representation of a third exemplary embodiment of a fuel injection system according to the present invention.

In the previously described exemplary embodiments, it is possible for irregularities in the pressure difference to occur because the individual throttles are located in assembly blocks which are connected together through lines, resulting in undesirable, additional throttling effects. Similarly, changes of the system pressure can lead to irregularities. These disadvantages are avoided in the exemplary embodiment illustrated in FIG. 3. In the embodiment of FIG. 3, the flow rate through a first throttle 33 is determined by a second throttle 46 across which a pressure regulating valve 47 maintains a constant pressure difference. The second throttle 46 and the pressure regulating valve 47 are disposed in parallel within a control pressure circuit 32. The pressure regulating valve 47 is embodied as a flat seat valve containing a diaphragm 50 as a movable valve member which separates a chamber 48 from a chamber 49. The chamber 49 contains a fixed valve seat 51 and a spring 52 urging the valve in the opening direction. Preferably the second throttle 46 is disposed within the diaphragm 50 and interconnects the chambers 48 and 49 of the pressure regulating valve 47. The change of the flow rate through the first throttle 33 is effected by disposing a third throttle 53 and in series therewith a solenoid valve 54 both in parallel with the second throttle 46 and the pressure regulating valve 47. When the internal combustion engine is stopped, the decay of system pressure to atmospheric pressure is prevented by a pressure limiting valve 55 disposed in a return line 38 behind the pressure regulating valve 47, limiting valve maintaining a predetermined pressure level within the fuel injection system.

A uniform change of the pressure difference across the first throttle 33 could be achieved, for example, by using a pressure regulating valve with adjustable preload instead of the fixed adjustment pressure regulating valve 40 or the valve 47, shown respectively in FIGS. 2 or 3.

The control pulses for the solenoid valve 35 or 54 are obtained in that the motor parameters are either measured electronically or else influence the opening time via an electrical control instrument after transformation into electrical parameters. Thus, for example, the control process can be based on the oxygen content in the exhaust gas, using a so-called oxygen sensor disposed in the exhaust system of the internal combustion engine. Such an oxygen sensor arrangement is shown, for example, in U.S. Pat. No. 3,828,749.

It may be required, for example, in V-type engines, perhaps due to non-uniform air distribution, that the regulation of the fuel-air mixture according to the aims of the present invention occurs separately for individual cylinders or cylinder groups.

A further exemplary form of the invention (not shown) provides that the equal pressure valves, such as the valves 24, are replaced by differential pressure valves embodied as flat seat valves including a diaphragm, such as the diaphragm 22, separating the two chambers, corresponding to the chambers 21 and 23, wherein the diaphragm is urged in the opening direction of the valves by a spring disposed in a chamber, such as the chamber 21.

This exemplary form has the advantage that fluctuations within the supply circuit influence the pressure difference prevailing at the metering valve, corresponding to the valve 18-19 to a substantially lesser degree and in that the pressure regulating valve, such as the valve 40, and the throttle, which corresponds to the throttle 37, can be eliminated in this modified varient of the exemplary embodiment according to FIG. 2.

It is to be appreciated that the foregoing description of exemplary embodiments of a fuel supply system are set out by way of example, not by way of limitation. Numerous varients and other embodiments are possible within the spirit and scope of the invention, the scope being defined in the appended claims.

What is claimed is:

1. In a fuel injection system for mixture compressing externally ignited internal combustion engines employing continuous injection into a suction tube which contains a measuring member as well as an arbitrarily actuatable butterfly valve, one disposed behind the other, and wherein said measuring member can be displaced by flowing air depending on air flow rate through said suction tube and in opposition to a resetting force and wherein the flowing air displaces a movable member of a metering valve disposed within a fuel supply line for the purpose of metering out a fuel quantity in proportion to the air quantity, the metering taking place normally while substantially a constant pressure difference prevails, the improvement comprising: a control pressure circuit which includes a first throttle; and a solenoid valve disposed in said control pressure circuit for controlling the flow in the control pressure circuit and thereby changing the pressure difference at said first throttle, said metering valve being controllably associated with said first throttle so that the pressure difference at said metering valve can be changed by the pressure difference at said first throttle.

2. A fuel injection system according to claim 1, wherein said first throttle is disposed between a fuel supply circuit and the metering valve.

3. A fuel injection system according to claim 2, wherein, downstream of said first throttle, there are disposed, in series, a chamber of a differential pressure valve, a second throttle, and said solenoid valve, said second throttle being disposed external to the metering valve.

4. A fuel injection system according to claim 3, wherein said differential pressure valve is a flat seat valve with a diaphragm, separating a first pressure chamber from a second pressure chamber, whereby said diaphragm is actuated in opening direction of this valve by a spring disposed in said second pressure chamber.

5. A fuel injection system according to claim 2, including a chamber of an equal pressure valve disposed downstream from said first throttle and within said control pressure circuit.

6. A fuel injection system according to claim 5, wherein downstream of said chamber of said equal pressure valve, there is disposed a second throttle and parallel thereto a third throttle associated with said solenoid valve.

7. A fuel injection system according to claim 5, wherein, downstream of said chamber of said equal pressure valve, there is disposed, within said control pressure circuit and parallel to a second throttle, a pressure regulating valve and a third throttle associated with said solenoid valve.

8. A fuel injection system according to claim 7, wherein said third throttle and said solenoid valve are disposed in series in the flow direction.

9. A fuel injection system according to claim 7, wherein said second throttle is disposed in a diaphragm of said pressure regulating valve embodied as a flat seat valve.

10. A fuel injection system according to claim 7, including a pressure limiting valve disposed downstream of said pressure control valve.

11. In a fuel injection system for mixture compressing externally ignited internal combustion engines employing continuous injection into a suction tube which contains a measuring member as well as an arbitrarily actuatable butterfly valve, one disposed behind the other, and wherein said measuring member can be displaced by flowing air depending on air flow rate through said suction tube and in opposition to a resetting force and wherein the flowing air displaces a movable member of a metering valve disposed within a fuel supply line for the purpose of metering out a fuel quantity in proportion to the air quantity, the metering taking place normally while substantially a constant pressure difference prevails, the improvement comprising: a control pressure circuit which includes a first throttle, said metering valve being controllably associated with said first throttle so that the pressure difference at said metering valve can be changed by pressure difference at said first throttle, said first throttle being disposed between a fuel supply circuit and said control pressure circuit; a solenoid valve disposed in said control pressure circuit for changing the pressure difference at said first throttle; a chamber of an equal pressure valve disposed downstream from said first throttle and within said control pressure circuit; a second throttle, said second throttle and said solenoid valve being disposed in series downstream of said chamber of said equal pressure valve within said control pressure circuit; and a third throttle disposed in said control pressure circuit, parallel to said solenoid valve.

12. A fuel injection system according to claim 11, including a pressure regulating valve disposed in said control pressure circuit, downstream of said solenoid valve.

* * * * *